United States Patent [19]

Gokcen et al.

[11] 4,301,935

[45] Nov. 24, 1981

[54] CONTAINER WITH HANGER

[75] Inventors: Cem M. Gokcen, Waukegan; Robert W. Gilbert, Libertyville, both of Ill.

[73] Assignee: Baxter Travenol Laboratories, Inc., Deerfield, Ill.

[21] Appl. No.: 111,017

[22] Filed: Jan. 10, 1980

[51] Int. Cl.[3] ..... B65D 23/10

[52] U.S. Cl. ..... 215/100 A; 220/94 R; 220/85 D

[58] Field of Search ..... 215/100 R, 100 A; 248/311.3, 317, 318, 359; 220/94 R, 85 D

[56] References Cited

U.S. PATENT DOCUMENTS

| | | | |
|---|---|---|---|
| 2,999,714 | 9/1961 | Ritchie | 220/94 R |
| 3,071,282 | 1/1963 | Walters | 220/85 D |
| 3,208,710 | 9/1965 | Barton | 248/359 |
| 3,215,299 | 11/1965 | Coanda | 220/94 A |
| 3,275,366 | 9/1966 | Hidding | 220/94 R |
| 3,299,442 | 1/1967 | White | 215/100 R |
| 3,412,887 | 11/1968 | Swartwoo | 215/100 A |
| 3,484,013 | 12/1969 | Speecher | 215/100 R |
| 4,010,862 | 3/1977 | Gilbert | 215/100 A |
| 4,013,187 | 3/1977 | Betka | 215/100 A |
| 4,093,169 | 6/1978 | Winchell | 215/100 A |

FOREIGN PATENT DOCUMENTS

| | | | |
|---|---|---|---|
| 794680 | 9/1968 | Canada | 215/100 A |

*Primary Examiner*—Herbert F. Ross

*Attorney, Agent, or Firm*—Paul C. Flattery; John A. Caruso; Gary W. McFarron

[57] ABSTRACT

A container and hanger therefor are disclosed, wherein the container has a bottom wall portion with a recessed or indented area in which support shaft means are located. An elongated hanger element has an aperture at each end for receiving the shaft means to form a hanger loop pivotable about the shaft means for movement between a position adjacent the recessed portion and a hanging position.

10 Claims, 7 Drawing Figures

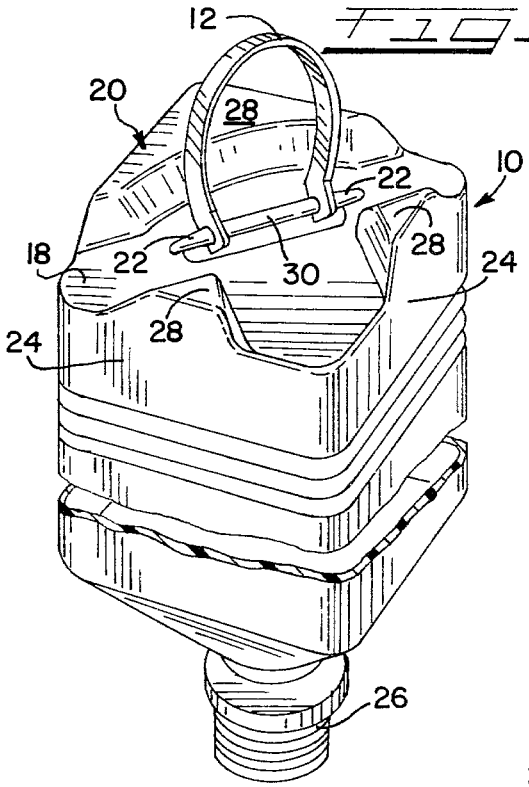
FIG. 1
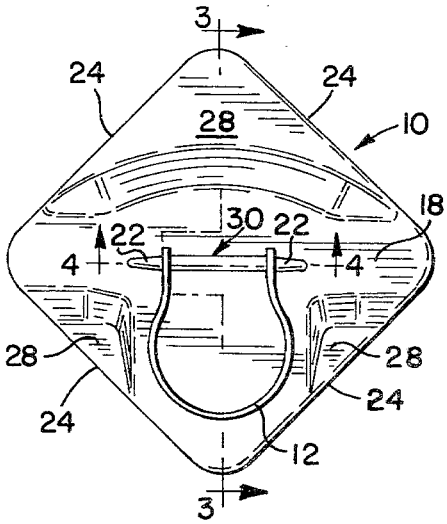
FIG. 2
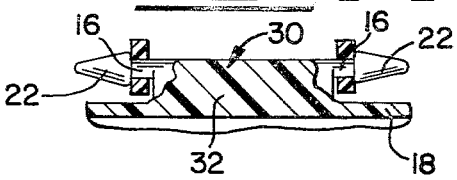
FIG. 4
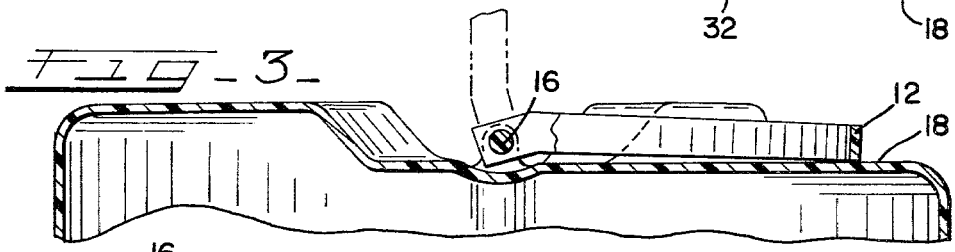
FIG. 3
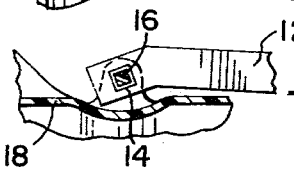
FIG. 7
FIG. 6
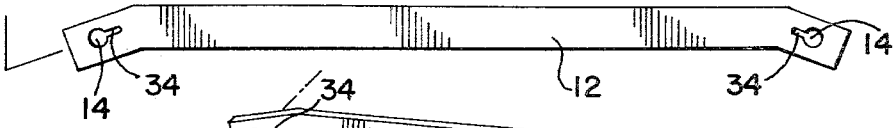
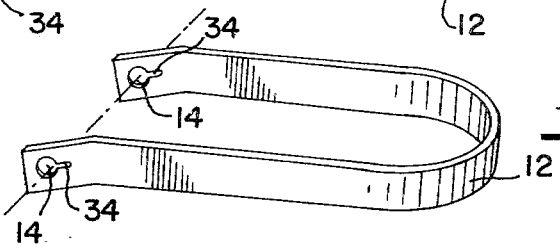
FIG. 5

CONTAINER WITH HANGER

The present invention relates generally to containers with hangers. More particularly, it relates to containers and hangers for suspending the containers in an inverted position for discharge of the contents.

Hangers have often been provided on containers, particularly those containing medical fluids such as parenteral solutions, sterile water and the like, for hanging the containers in an inverted position for gravitational discharge of the fluid to a patient. Typically the hanger is attached to the bottom of the container, and, when not in use, is received within a recess in the bottom so as not to interfere when the container is set in an upright position. Although such containers and hangers have been provided in a variety of shapes and configurations, there is a continuing need for containers and hangers which are easy to produce and assemble at relatively low cost and with high strength to suspend large containers or bottles of liquid. For example, in U.S. Pat. Nos. 3,215,299 and 3,387,732, hangers are molded as one piece with plastic parenteral fluid containers. In the '299 Patent, the hanger is held in a folded-down position against the bottom of the container by a heat-set of the plastic which occurs during sterilization. In the '732 Patent, the hanger is snapped into undercuts in the bottom of the container. The drawback of these hangers is that it is often difficult to mold containers with integral hangers or with undercuts without creating an undesirable amount of waste. This is particularly true when oriented plastic processes, which result in a container of improved clarity, are used.

To avoid the difficulty of molding a hanger as one piece with the container, hangers have also been provided separately and attached to the container after molding is complete. For example, in U.S. Pat. No. 4,013,187, a separate hanger element is attached to a container by sliding a C-shaped support bar of the hanger element over a T-shaped rib on the bottom of the container. However, the container there continues to employ undercuts to hold the hanger in a lay-down position against the bottom of the container, which, as noted earlier, are also difficult to mold and result in an unsatisfactory amount of waste. An example of a separate hanger which does not require undercuts is described in U.S. Patent Application Ser. No. 025,261, entitled "Plastic Hanger for Containers", filed Mar. 29, 1979. That application describes a hanger element molded separately from a container and later attached via plastic melt-seal between the container and hanger. The hanger is molded in a normal "lay down" position, which keeps the hanger from interfering with resting the container on a flat surface and does not require undercuts or lugs on the bottom of the container. The plastic melt-seal between the hanger and bottle, while also reducing the possibility of accidental separation between the hanger and container, requires additional manufacturing steps and equipment to produce the container and hanger.

Accordingly, it is a general object of the present invention to provide a further improved hanger and container combination.

It is a more particular object of the present invention to provide a container with a hanger element which is molded separately and can be easily assembled onto the container without additional processes or equipment.

It is yet another object of the invention to provide such a hanger which does not interfere with resting the container on a flat surface and does not require hold-down undercuts or lugs on the bottom of the container.

Further objects and advantages of the present invention will be apparent from the following detailed description of the preferred embodiment of the present invention as illustrated in the attached drawings of which:

FIG. 1 is a perspective view of an inverted container and hanger embodying the present invention.

FIG. 2 is a plan view of the bottom of the container of FIG. 1 with the hanger element in a lay-down position adjacent the bottom of the container.

FIG. 3 is a cross-sectional view taken along line 3—3 of FIG. 2.

FIG. 4 is a cross-sectional view taken along line 4—4 of FIG. 2.

FIG. 5 is a perspective view of the hanger element in a bent position as fitted on the bottom of the container.

FIG. 6 is a plan view of the hanger element before it is fitted onto the container.

FIG. 7 is a partial cross-sectional view, similar to FIG. 3, of an alternative embodiment of the present invention.

The present invention is generally emboided in a container 10 for medical fluid such as sterile water, parenteral solutions or the like, and in a separate hanger element 12 attached to the container for hanging it in an inverted position to discharge the contents. In accordance with the present invention, the hanger element 12 is easily attached to the container by fitting end apertures 14 onto support shafts 16 located within a recessed area or portion 18 in the bottom wall 20 to form a hanger loop. The end apertures 14 are sized to rotate around the support shafts 16 so that the hanger loop may be pivoted between a hanging position (FIG. 1 and dashed lines in FIG. 3) and a lay-down position adjacent to the recessed wall portion 18 so as not to interfere with setting the container uprights (FIGS. 2 and 3). Friction between the hanger element 12 and the support shafts 16 keep the hanger in a lay-down position without the necessity of undercuts or lugs in the bottom of the container, and snap-fit of the apertures 14 over bulbous tips 22 on the support shafts 16 prevents accidental separation of the hanger and container.

Turning now to a more detailed description, the container 10 in the illustrated embodiment is a plastic, blow-molded bottle of the type typically filled with sterile water, saline solution or the like. Although the container may be made from any of a variety of plastic materials, it is preferably made of polypropylene or polyethylene and molded employing a technique which orients the plastic longitudinally and circumferentially, resulting in improved strength and clarity. The container is of generally rectangular shape, with four sidewalls 24 closed at one end by the bottom wall 20 and terminating in a threaded neck portion 26 at the other end, through which the contents may be dispensed when the container is inverted.

The recessed or indented area 18 in the bottom wall provides a space in which the hanger may be attached and reside without interfering when the bottle is set upright on a flat surface. As best seen in FIGS. 1 and 2, the recessed area has a diagonal portion which extends between two opposite corners of the container, and in which the support shafts 16 are located, and a hanger loop-receiving portion generally perpendicular to the diagonal portion and extending to a third corner of the container. This construction divides the raised area of the bottom of the container into several support surfaces 28 upon which the container rests when in the upright position.

The support shafts 16 to which the hanger element 12 is attached are part of a support element 30 molded integrally, as one-piece, in the bottom wall 20 container, along the diagonal portion of the recessed area 18. Referring to FIGS. 2 and 4, the support element 30 has an elongated solid center portion 32 which upstands from the recessed wall 18. The bulbous-tipped support shafts 16 extend in opposite horizontal directions from each end of the center portion. Although various shapes may work satisfactory, the support shafts 16 are generally cylindrical in cross-sectional shape and terminate in the bulbous tip 22 which serve to retain the hanger element 12 on the shaft. Preferably, the tip is conically shaped for easier snap fit through the apertures 14 in each end of hanger element 12.

The hanger element 12 itself, as noted earlier, is molded or otherwise fabricated, separately from the bottle 12. It may be made of any of a variety of thermoplastic materials that are sufficiently strong to support a relatively large, 2–4 liter, container filled with liquid. The preferred material for the hanger is the same as that for the bottle, polypropylene or polyethylene.

Turning to FIGS. 5 and 6, the hanger element 12 is preferably a thin, flexible plastic strap of one piece construction, although other shapes are also within the scope of the present invention. Each end of the strap, in which the apertures 14 are located, is downturned at an angle of about 10 degrees so that when attached to the container, the hanger loop is directed into closer positioning adjacent the bottom of the container. The apertures 14 of the hanger strap correspond in shape to the support shafts and thus are preferably circular openings to receive the cylindrical support shafts. Although the apertures must be sized to permit rotation about the support shafts, the size may be varied to increase or decrease the frictional force between them, for example, to provide for easier rotation or to provide additional friction force to help hold the hanger in a selected position. Even when the apertures are much larger than the support shafts, the natural outward spring force of the hanger element, which is bent into a U-shape when attached to the container provides sufficient frictional force against the bulbous tips 22 to hold the hanger in a selected, e.g., lay-down position, without requiring undercuts or lugs on the bottle bottom as was required in the earlier discussed hangers. An alternative to frictional force hold-down, as shown in FIG. 7, is to have the apertures 14 of a non-circular shape, e.g., square, to correspond to a matching cross-sectional shape of the support shaft 16, which would provide a resilient detent arrangement to hold the hanger element in either the lay-down or upstanding position.

The hanger element 12 is attached to the container 10 by bending it into a generally U-shape and snap-fitting the apertures 14 over the conical tips 22 on each of the support shafts 16. The inherent resiliency of the plastic strap may permit temporary stretching enlargement of the apertures 14 to slide over the conical tips 22, but preferably a line of weakness, such as a slit 34 which extends radially outwardly of the aperture, permits temporarily enlargement of the aperture as the hanger element is fit over shaft tip 22. Mounted in this manner, the hanger element 12 may be easily pivoted between a hanging position substantially perpendicular to the bottom wall (FIG. 1) for hanging the container upside-down, and a lay-down position approximately parallel to the recessed surface 18 of the bottom wall 20 (FIGS. 2 and 3) to permit the container to be set upright. In the lay-down position, the downwardly angled ends of the strap direct the hanger loop toward the bottom surface of the container to better keep it within the recessed portion 18.

In conclusion, with the hanger system and container construction shown above, the hanger element 12 is easily and simply attached to the container by snap-fit over the container's support shafts 16. Lugs or undercuts are not required on the bottom of the container, as friction or detents between the apertures 14 and the support shafts 16 hold the hanger in an out-of-the-way lay-down position within recessed area 18 in the bottle bottom. When the container needs to be hung in the inverted position, the hanger element is merely rotated from the recess into the hanging position as shown in FIG. 1.

The present invention has been described in terms of the preferred embodiment for the purpose of illustration and not limitation. It is intended that the present application, as defined in the following claims, also cover those equivalent structures, some of which may be apparent upon reading this description and others which may become apparent upon reading this description and others which may become apparent only after some study.

I claim:

1. A suspendable container comprising a one-piece plastic body including an indented bottom wall portion, suspension means carried by said bottom wall for hanging said container in an inverted position, said suspension means comprising a support shaft means integral with said bottom wall said suspension means being disposed within said indented bottom wall portion so as not to interfere with the container resting on a flat surface, and a separate elongated hanger element carried by said shaft means, said hanger element having an essentially keyhole shaped aperture at each end, and said shaft means having at least a pair of enlarged end portions, each rotatably received within one of said aperture to provide a hanger loop to allow the container to be suspended in an inverted position, said apertures being slightly smaller than said shaft to frictionally engaging said shaft means to permit said hanger loop to be maintained securely within said indented bottom wall portion without the use of a restraining means engaging said hanger loop, and said hanger element angled to be closely adjacent said indented bottom wall portion when said hanger loop is not being used to invertedly hang said container.

2. A suspendable container in accordance with claim 1 wherein said elongated hanger element is straped shaped.

3. A suspendable container in accordance with claim 1 wherein said shaft means comprises a pair of shafts each of which is received within one of said apertures.

4. A suspendable container in accordance with claim 3 wherein said enlarged end portions provide retaining means on at least one end thereof for preventing accidental separation of said hanger element from said suspension shaft.

5. A suspendable container in accordance with claim 4 wherein retaining means comprises said enlarged portion for snap-fit through said aperture.

6. An aperture in accordance with claim 5 wherein said essentially keyhole shaped apertures each included a peripheral line of weakness for temporary enlargement of said aperture when snap-fit over said enlarged portion.

7. An aperture in accordance with claim 6 wherein said line of weakness is a slit.

8. A plastic container for sitting upright and for hanging inverted comprising: a one-piece plastic body including a bottom wall portion, said bottom wall portion including a portion for setting upright and an indented wall portion, support shaft means of one-piece construction with said indented wall portion, an elongated hanger strap including an essentially keyhole shaped aperture at each end for rotatably receiving said support shaft means to provide a hanger loop for hanging said container in an inverted position, said support shaft having an enlarged retaining portion on each end for snap-fit through said aperture, said hanger element being pivotable on said support shaft means between a position adjacent to said indented wall portion and a hanging position, said apertures being slightly smaller than said shaft to frictionally engage said shaft means to permit said hanger loop to be maintained securely within said indented bottom wall portion without the use of restraining means engaging said hanger loop, and said hanger element angled to lie closely adjacent said indented bottom wall portion when said hanger loop is not being used to invertedly hang said container.

9. A container in accordance with claim 8 wherein said enlarged retaining portion is conically shaped.

10. A container in accordance with claim 8 wherein said aperture is of non-circular shape and said shaft means has a matching non-circular cross-sectional shape.

* * * * *